US010551109B2

(12) United States Patent
Cho et al.

(10) Patent No.: US 10,551,109 B2
(45) Date of Patent: Feb. 4, 2020

(54) DUCT STRUCTURE FOR COOLING CONTAINER-SPACE OF DOOR AND REFRIGERATOR USING THE SAME

(71) Applicant: LG ELECTRONICS INC., Seoul (KR)

(72) Inventors: Yong Hyeon Cho, Seoul (KR); Sunghee Kang, Seoul (KR); Daesig Shin, Seoul (KR); Kihwang Kim, Seoul (KR); Dong Hyoung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/790,215

(22) Filed: Oct. 23, 2017

(65) Prior Publication Data

US 2018/0112905 A1 Apr. 26, 2018

(30) Foreign Application Priority Data

Oct. 26, 2016 (KR) ..... 10-2016-0139960

(51) Int. Cl.
*F25D 17/08* (2006.01)
*F25D 17/06* (2006.01)

(52) U.S. Cl.
CPC ..... *F25D 17/08* (2013.01); *F25D 17/062* (2013.01)

(58) Field of Classification Search
CPC ..... F25D 17/08; F25D 17/062; F25D 23/025; F25D 2317/062; F25D 2317/067; F25D 2323/021; F25D 2323/023
USPC ..... 62/407, 413
See application file for complete search history.

(56) References Cited

U.S. PATENT DOCUMENTS 6,094,931 A * 8/2000 Jeong ..... F25D 17/065 454/193
7,254,960 B2 * 8/2007 Schmid ..... F25D 17/045 62/407
2010/0326113 A1 * 12/2010 Kuehl ..... F16L 9/003 62/259.1
2013/0033163 A1 * 2/2013 Kang ..... F25D 23/025 312/405.1

(Continued)

FOREIGN PATENT DOCUMENTS

JP 10238925 A 9/1998
KR 10-1999-0060422 7/1999

(Continued)

OTHER PUBLICATIONS

Machine translation JP10238925.*

*Primary Examiner* — Joseph F Trpisovsky
(74) *Attorney, Agent, or Firm* — Fish & Richardson P.C.

(57) ABSTRACT

A duct structure of a refrigerator equipped with a door provided with a container space separated from an internal space of the refrigerator comprises: a multi-duct which is provided in a rear space in the internal space of the refrigerator and which discharges cool air into the internal space of the refrigerator while allowing air to flow upward; a connecting outlet which is provided in an upper end of the multi-duct; a connecting duct which communicates with the connecting outlet and which is extended in a front-rear direction; a front duct which is connected to a front end of the connecting duct and which is extended in a left-right direction; and a nozzle unit which is provided in a lower portion of the front duct and which discharges cool air into the container space of door.

20 Claims, 9 Drawing Sheets

(56) References Cited

U.S. PATENT DOCUMENTS

2013/0276473 A1* 10/2013 Takahashi ..... F25D 17/08
62/411

FOREIGN PATENT DOCUMENTS

| | | |
|---|---|---|
| KR | 20070080338 | 8/2007 |
| KR | 20120072775 | 7/2012 |
| KR | 20130015988 | 2/2013 |
| KR | 101466658 | 11/2014 |

* cited by examiner

DUCT STRUCTURE FOR COOLING CONTAINER-SPACE OF DOOR AND REFRIGERATOR USING THE SAME

CROSS-REFERENCE TO RELATED APPLICATION

This application claims priority to and the benefit of Korean Patent Application No. 10-2016-0139960, filed on Oct. 26, 2016, the disclosure of which is incorporated herein by reference in its entirety.

BACKGROUND

The present application relates to a duct structure of a refrigerator, and more particularly, to a duct structure capable of achieving a uniform cold storage of refrigerator in a container space of a door side and a cabinet by separately supplying cool air to a container space provided in a door side of refrigerator, and a refrigerator using the same.

SUMMARY

FIG. 1 illustrates a refrigerator 10 including a door 20 having an outer door 25 and an inner door 30. Generally, shelves are installed in the internal space of a cabinet 11 of the refrigerator. The shelves are installed to efficiently use the internal space of the refrigerator. When the shelves are installed, the internal space of the refrigerator is divided into a plurality of spaces by the shelves. In addition, a basket or a container space is provided in the door 20 side of the refrigerator so as to store foods that need to be frequently taken out such as drinks.

Particularly, in the case of a door provided with the outer door 25 and the inner door 30, the inner door is separately designed so as to prevent the cool air in an internal space of the refrigerator from flowing out when the door is opened and closed. Therefore, a partition cover is provided in an inner side of a door in the refrigerator so as to partition an internal space of the refrigerator and a container space of the door. The partition cover is provided with an opening for allowing the container space of the door to communicate with the inside of the refrigerator so that the cool air in the inside of the refrigerator can be supplied to the door-side container space.

However, since the shelf having a bottom plate made of glass or transparent synthetic resin material has a shape in which the bottom plate is closed, it is difficult to expect a smooth air flow between the plurality of divided spaces separated by the shelf. In addition, when the food placed on the shelf obstructs the cool air discharged toward the front in a multi-duct provided in a rear side of the cabinet, the cool air is not smoothly supplied to the container space side of the door.

Furthermore, the partition cover is installed in the door so as to minimize the outflow of cool air inside the refrigerator when a second door, e.g., the inner door 30 is opened. Hence, the opening of the partition cover is not so large.

According to this conventional refrigerator structure, when the inner door 30 is opened to take out the food in the container space of the door, the outflow of cool air can be significantly reduced. However, as mentioned above, the food stored in the refrigerator interferes with a pre-designed cool air flow, and a gap between a temperature inside the refrigerator and a temperature in the door-side container space may occur.

The present invention has been made in view of the above problems, and provides a duct structure which is capable of smoothly supplying cool air to a container space side of a door irrespective of storage position or state of food inside refrigerator, by supplying cool air directly to a container space provided in a door without passing through an internal space of the refrigerator, and a refrigerator using same.

The present invention further provides a duct structure which is capable of supplying cool air directly to a container space provided in an inner side of a partition cover separately from a cool air inside refrigerator or without the cool air inside refrigerator, when the partition cover is disposed in a container space provided in a door to prevent the cool air from flowing out, and a refrigerator using the same.

The present invention further provides a duct structure capable of supplying cool air directly and smoothly to a container space of door side with a simple structure, and a refrigerator using the same.

The present invention further provides a duct structure capable of smoothly supplying cool air to a container space of a plurality of doors provided in a front surface of refrigerator, and a refrigerator using the same.

In accordance with an aspect of the present invention, a duct structure of a refrigerator equipped with a door provided with a container space separated from an internal space of the refrigerator includes: a multi-duct which is provided in a rear space in the internal space of the refrigerator and which discharges cool air into the internal space of the refrigerator while allowing air to flow upward; a connecting outlet which is provided in an upper end of the multi-duct; a connecting duct which communicates with the connecting outlet and which is extended in a front-rear direction; a front duct which is connected to a front end of the connecting duct and which is extended in a left-right direction; and a nozzle unit which is provided in a lower portion of the front duct and which discharges cool air into the container space of door.

According to this structure, cool air of the duct provided in the rear side of the cabinet is directly supplied to the door side without passing through internal space of the refrigerator, so that it is possible to maintain the constant temperature of the container space of the door and to reduce the temperature gap between the door-side container space and the internal space of cabinet.

The multi-duct includes a first partitioning portion and a second partitioning portion which divide the cool air flow supplied from a lower portion into two halves horizontally, and wherein, among the first partitioning portion and the second partitioning portion, a width of the partitioning portion which is provided with the connecting outlet is wider than a width of the other partitioning portion. Thus, it is possible to secure a supply amount of cool air so that cold air can be smoothly supplied to the connecting duct.

The connecting outlet is provided in one side end of an upper end of the multi-duct, and a guide wall for guiding a flow of cool air to the connecting outlet is provided in a flow space of multi-duct leading to the connecting outlet. Thus, the cold air is previously separated before the flow path of the air reaches the end of the multi-duct, and it is possible to secure the supply of cold air so that cold air can be smoothly supplied to the connecting duct.

The multi-duct has a width which is increased as progressing upwardly, and the guide wall has a triangular shape having a width which is increased as progressing upwardly. According to this structure, the multi-duct can be disposed near the center, while the connecting duct can be installed close to the end, so that the utilization of the space in the refrigerator can be maximized. In particular, when the upper side of the triangular branch shape is installed so as to occupy all the wall portion between the outlet provided at the uppermost end of the multi-duct and the connecting outlet, the flow of cool air does not collide with the deadly inner wall, thereby preventing the flow loss.

The connecting outlet is provided upward from an upper end of the multi-duct, and a rear end of the connecting duct is connected to the connecting outlet through a first refraction portion. According to this structure, since the multi-duct may not be extended to the ceiling portion of the cabinet, the multi-duct can be easily installed, and a first refraction portion and the connecting duct can be disposed on the ceiling portion side of the cabinet, thereby sending cold air toward the front side without changing the shape of the existing cabinet.

The first refraction portion is provided in a refraction pipe which is a separate component from the connecting duct. When the refraction pipe is manufactured as a separate component from the connecting member or the multi-duct, not only the production of each component can be simplified, but also the components can be commonly used in the refrigerator of different specifications and the compatibility can be enhanced.

The connecting duct has a flow cross-section of a rectangular shape having a longer width from side to side, and the connecting duct includes a partitioning wall dividing the flow cross-section into two parts from side to side along a longitudinal direction. This partitioning wall increases the flow velocity of air in the flat and long connecting duct.

The front duct is provided with a second refraction portion which is connected to a front end of the connecting duct and which changes a flow direction of air. It is preferable for the second refraction portion to have a streamlined flow trajectory that smoothly changes the flow direction of the air flowing from the rear side to the front side to the front duct side.

The second refraction portion communicates with a manifold portion having an inner flow space extending to right and left sides of the front duct, and a guide accelerating portion having a flow cross-sectional area gradually decreasing from the second refraction portion toward the manifold portion is provided between the second refraction portion and the manifold portion. Thus, the flow velocity of the cold air passing through the long flow path can be increased again. It is also important that a large amount of cold air is supplied to the container space of the door. However, considering that the cold air can be uniformly distributed even in the container space of the door only when the cold air should be supplied into the container space at a certain flow velocity or more, the above-described acceleration structure is effective for the constant temperature operation of the container space and the temperature gap reduction.

The nozzle unit provided in a lower portion of the manifold portion is provided with a split vane for dividing a discharge cross section. Thus, when the cool air is discharged finally into the container space of the door, the flow velocity of the cool air can be increased and the discharge direction of the cool air can be controlled as an optimum direction.

In accordance with another aspect of the present invention, a refrigerator includes: a cabinet which is provided with an internal space for storing food therein; a first door which is provided in a front side of the cabinet to open or close the internal space and which is provided with a container space separated from the internal space; a multi-duct which is provided in a rear space in the internal space of the refrigerator and which discharges cool air into the internal space of the refrigerator while allowing air to flow upward; a connecting outlet which is provided in an upper end of the multi-duct; a connecting duct which communicates with the connecting outlet and which is extended in a front-rear direction; a front duct which is connected to a front end of the connecting duct and which is extended in a left-right direction; and a nozzle unit which is provided in a lower portion of the front duct and which discharges cool air into the container space of door.

The door is provided with a second door which is installed to be openable and closable so as to be able to approach the container space of door from a front side of a first door forming an outer side of the door. Thus, it is possible to access the container space of the door by opening only the second door without opening the entire door.

The door is provided with a pair of doors in left and right sides, and the nozzle unit is provided corresponding to the container spaces of the two doors respectively. Thus, it is possible to smoothly provide cool air to both container spaces of the two doors.

A partition cover for partitioning the container space and the internal space is provided in an inner side of the door, and even though such a partition cover is disposed, it is possible to smoothly supply cool air into the container space.

BRIEF DESCRIPTION OF THE DRAWINGS

The objects, features and advantages of the present invention will be more apparent from the following detailed description in conjunction with the accompanying drawings, in which.

DETAILED DESCRIPTION

Exemplary implementations of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Figure 1:
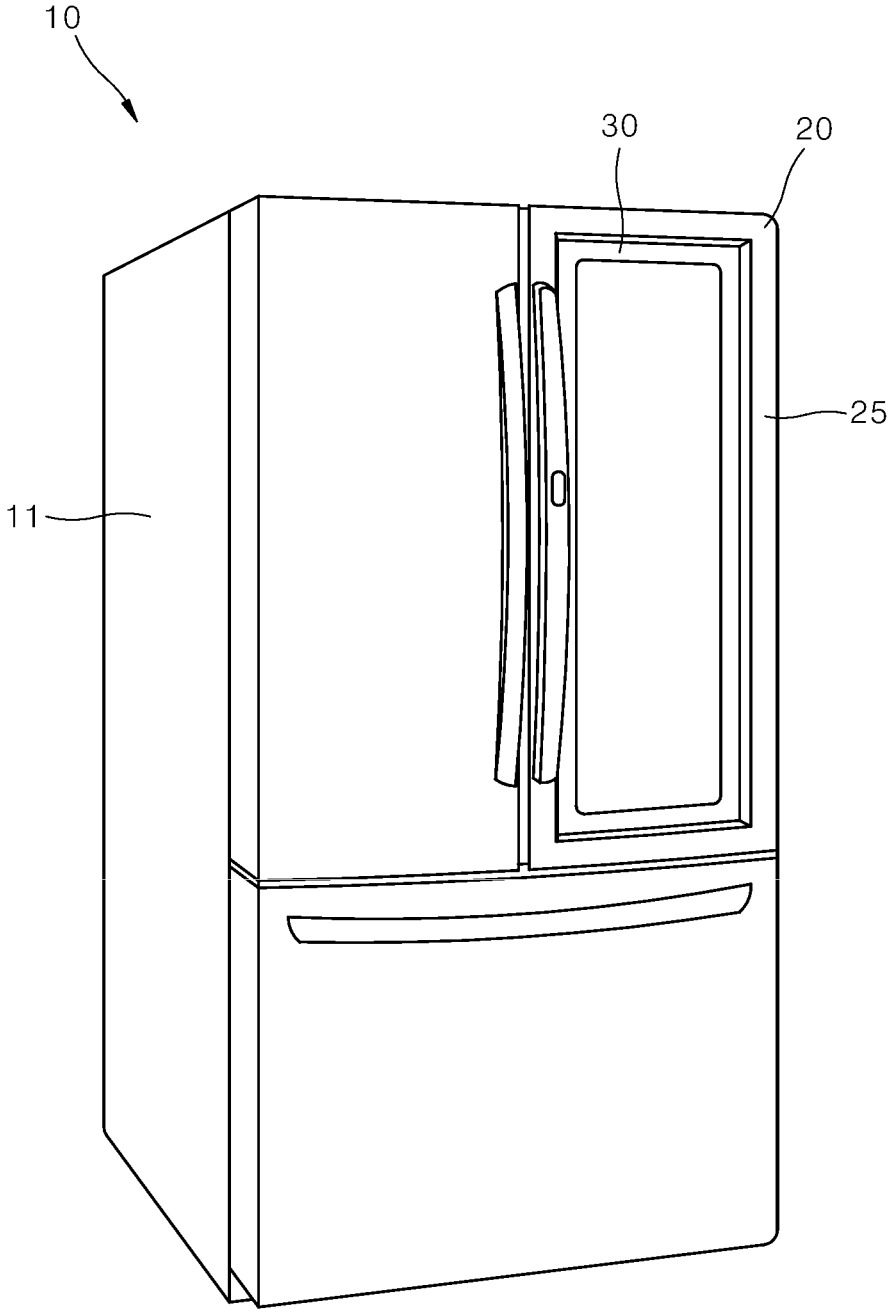
FIG. 1 is a perspective view showing a bottom freezer type refrigerator having a pair of left and right doors at an upper portion and having an outer door and an inner door.

Hereinafter, an implementation of a refrigerator using an duct structure according to the present invention is described with reference to FIG. 6, which is a perspective view showing the inside of a refrigerator using a duct structure in a rear upper portion, together with FIG. 1.

In an implementation of the present invention, a refrigerator 10 is a bottom freezer type refrigerator which is equipped with a freezing compartment at a lower portion and a refrigerating compartment at an upper portion. Here, a freezing compartment having a single door identical with the width of the refrigerator is provided in the lower portion, and two doors 20 are provided in the upper portion in a width direction of the refrigerator to provide a side-by-side type refrigerating compartment in which two doors 20 rotate around both ends of the refrigerator when the handle of the center is pulled. When the refrigerator is viewed from the front, one side (the right side in FIG. 1) door 20 is implemented with a door-in-door type door and the other side (the left side in FIG. 1) door is implemented with a general type.

Figure 6:
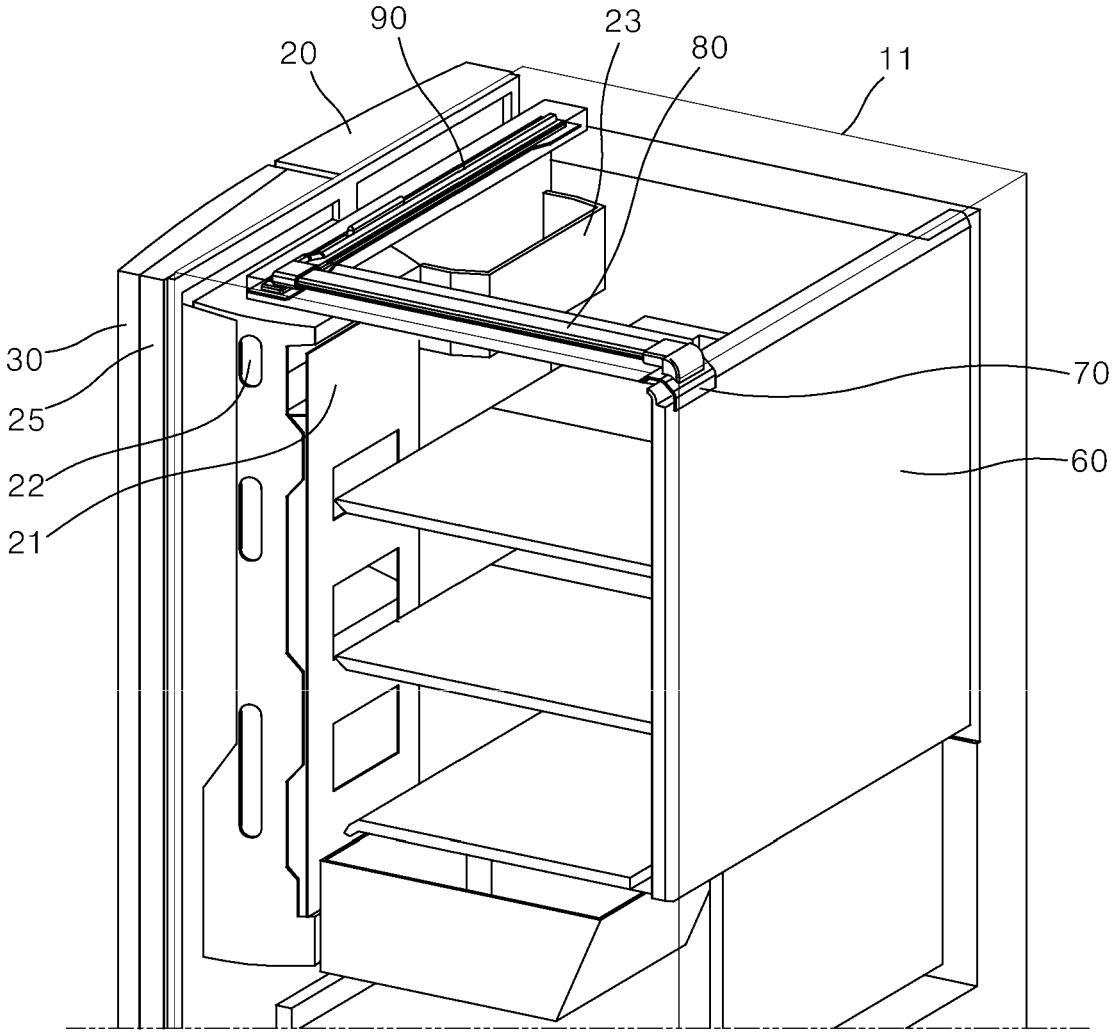
FIG. 6 is a perspective view showing the inside of a refrigerator using a duct structure in a rear upper portion.

As shown in the right side of FIG. 6, a door of a general type is provided with a basket 23 for storing food therein. The basket supports the bottom and side surface of the storage space.

On the other hand, the door-in-door type door is a structure in which a second door 30 is installed in a first door 25, so that the first door 25 serves as an outer door constituting the outer portion of the door 20, and the second door 30 serves as an inner door constituting the surface of the door 20. As shown in the left side of FIG. 6, the first door includes a partition cover 21 for partitioning a container space for food stored in the basket and an internal space of refrigerator in the cabinet 11 side, together with the basket in the inner side of the door.

When the first door 25 is opened, the second door 30 is opened together with the basket and the partition cover 21 provided in the rear of the door such that a user can access to the internal space of the refrigerator. On the other hand, when only the second door 30 is opened in a state where the first door 25 is closed, only the front portion of the door 20 is opened and the container space of door can be accessed from the outside, i.e., from the front of the refrigerator, and the container space is kept partitioned from the internal space of the refrigerator by the partition cover 21. The partition cover 21 prevents the cool air in the internal space of the refrigerator from escaping to the outside when only the second door 30 is opened as described above, while allowing a slight air flow between the space in the internal space of the refrigerator and the container space of the door.

Figure 2:
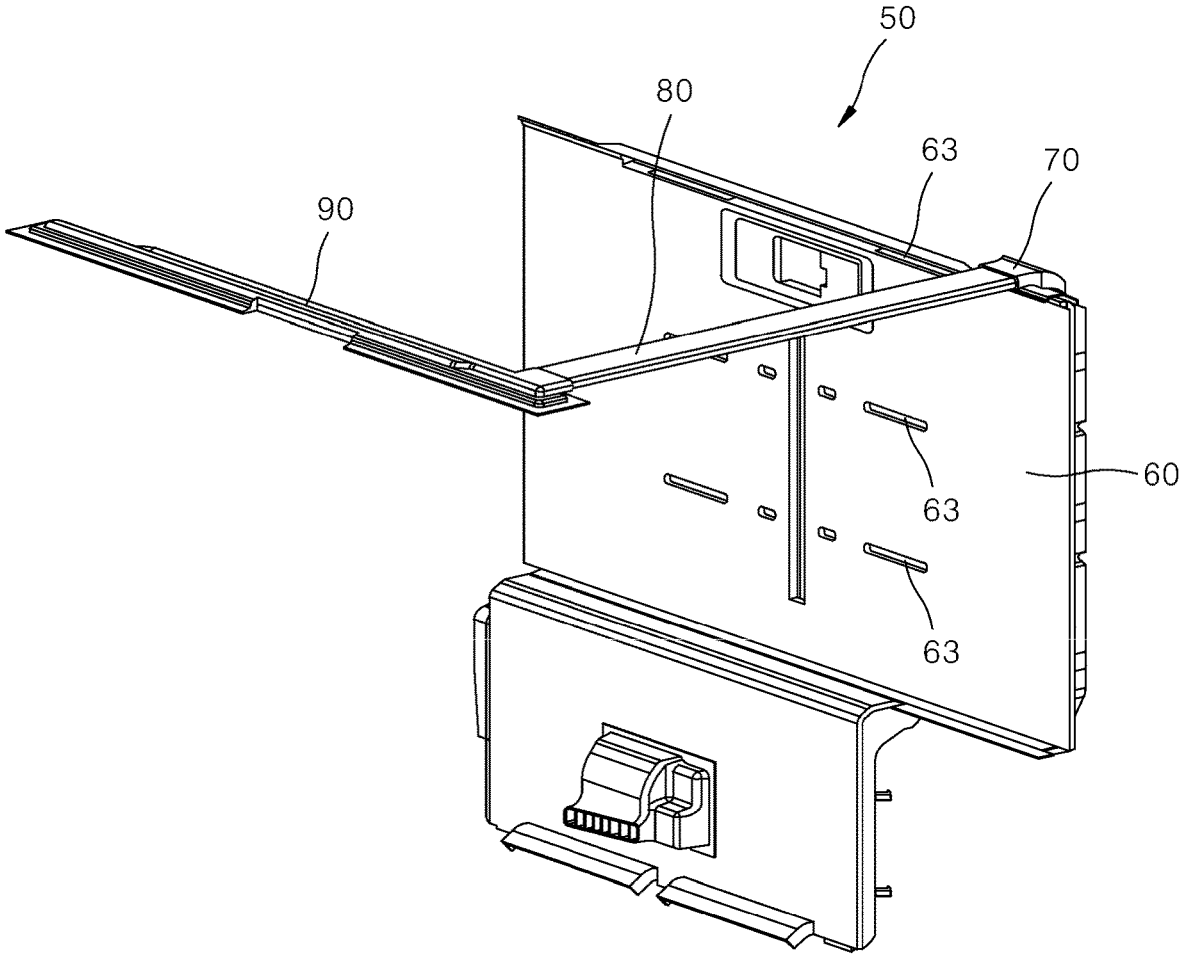
FIG. 2 is a perspective view of a duct structure of a refrigerator viewed from a front side according to the present invention.

A plurality of shelves are provided in the internal space of the refrigerator to implement a three divided spaces which are arranged in the vertical direction, and cool air is discharged to each of the spaces from an outlet 63 (See FIG. 2) of a multi-duct 60 provided in the rear of the cabinet 11 such that cooling is achieved. A part of the cool air discharged from the outlet of the multi-duct 60 passes through the internal space of the refrigerator and flows into the container space in the door 20 side through an open space of the partition cover 21 while the door 20 is closed.

Referring to FIGS. 2 to 9, the installation structure of ducts for passage of cool air in order to cool the refrigerator according to the present invention includes a multi-duct 60 installed in the rear of the cabinet, a connecting duct 80 which is connected to an upper portion of the multi-duct and extended frontward and which serves as a passage for flowing the air flowing in the multi-duct frontward, and a front duct 90 which is connected to a fore-end of the connecting duct 80 and extended in the width direction at the front upper portion of the cabinet and which serves as a passage for flowing the cool air which is flown frontward through the connecting duct in the width direction of the refrigerator.

Figure 3:
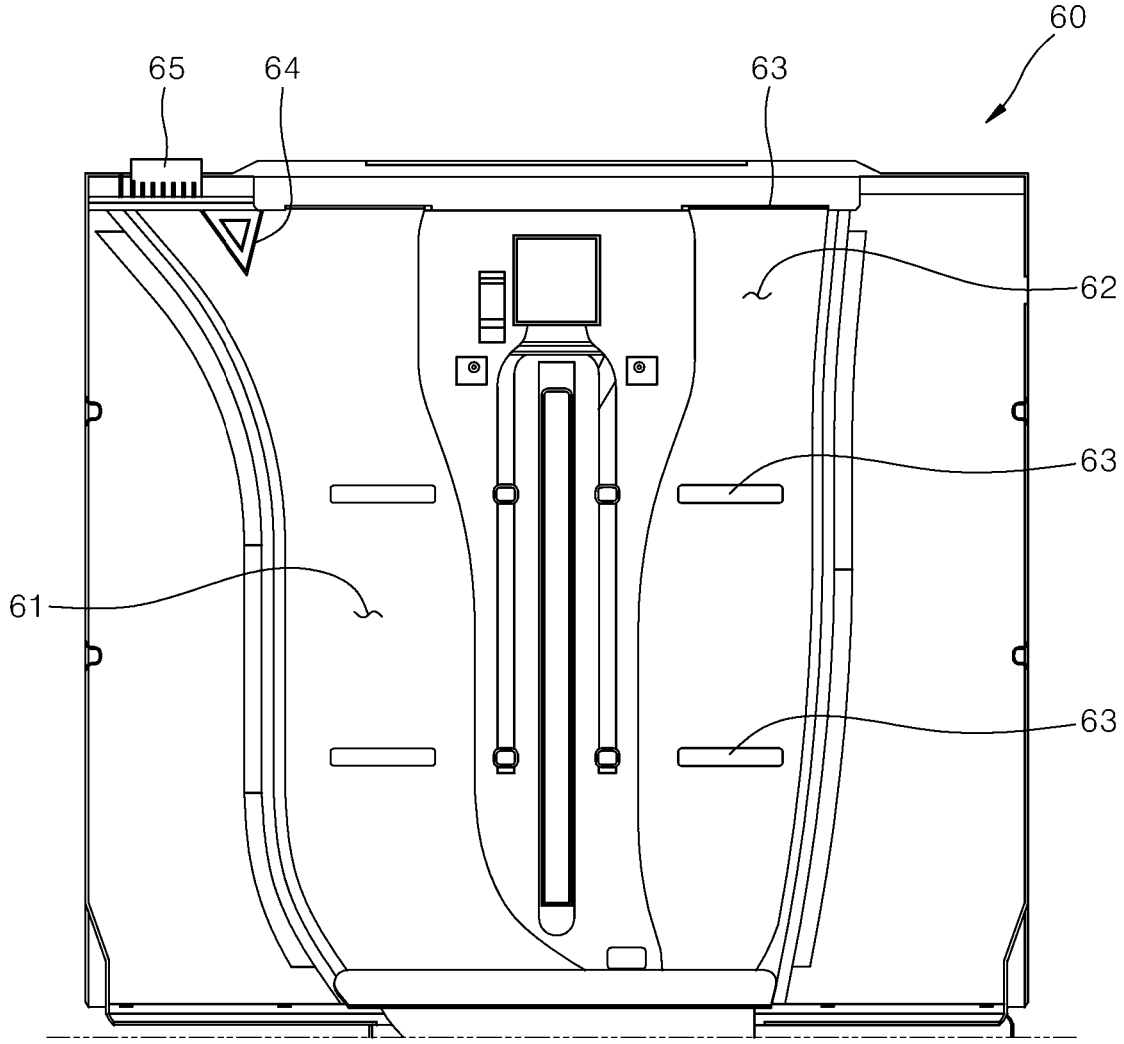
FIG. 3 is a cross-sectional view of a multi-duct viewed from a rear side for showing an internal structure of the duct structure of FIG. 2.

As shown, the multi-duct 60 is a flat type and is provided with an air flow path through which air flows from the lower portion to the upper portion. Referring to FIG. 3, the cool air blown from the lower portion is divided into a flow path of the side of a first partitioning portion 61 in the left side in the drawing and a flow path of the side of a second partitioning portion 62 in the right side, and flows to the upper portion. The first partitioning portion 61 and the second partitioning portion 62 are provided with outlets 63 which are formed in a position corresponding to respective internal spaces of the refrigerator separated by the shelves described above and which discharge cool air into the respective internal spaces of the refrigerator.

As some cool air is discharged to the respective outlets 63 while cool air flows from the lower portion in the multi-duct 60 to the upper portion, the amount of cool air transmitted to the upper portion gradually decreases. In this case, if the widths of the upper and lower ducts are equal to each other although the amount of the cool air decreases, the flow velocity of the cool air decreases when progressing upwardly such that the flow velocity of the cool air discharged through the outlet of an upper end portion decreases. In view of this, in the implementation of the present invention, in the vicinity of the upper end portions of the first partitioning portion 61 and the second partitioning portion 62, the width is reduced so that an air flow area may be reduced in comparison with the lower portion. Thus, the flow velocity of the cool air increases and the cool air can be smoothly discharged even in the case of the outlet 63 of the uppermost end.

Further, when a structure (not shown) for opening the uppermost outlet upwardly and guiding the flow direction of the air discharged upward through the outlet frontward (i.e., toward the internal space of the refrigerator) is provided, the flow velocity of the cool air discharged into the uppermost shelf space can also be sufficiently secured.

Meanwhile, according to the present invention, among the first partitioning portion of the multi-duct 60 and the second partitioning portion, the width of the partitioning portion which is connected to the above described connecting duct 80 is larger than the width of the other partitioning portion. Accordingly, much more cool air flows in a corresponding partitioning portion as much as the amount of the cool air that should flow toward the front of the cabinet through the connecting duct. In the multi duct 60, the connecting duct 80 is connected to the first partitioning portion 61 side. The width of the first partitioning portion 61 is larger than that of the second partitioning portion 62, and the distribution ratio is about 6:4. The width of the first partitioning portion 61 is about 50% wider than the second partitioning portion. According to this structure, cool air can be supplied toward the connecting duct more smoothly.

Figure 4:
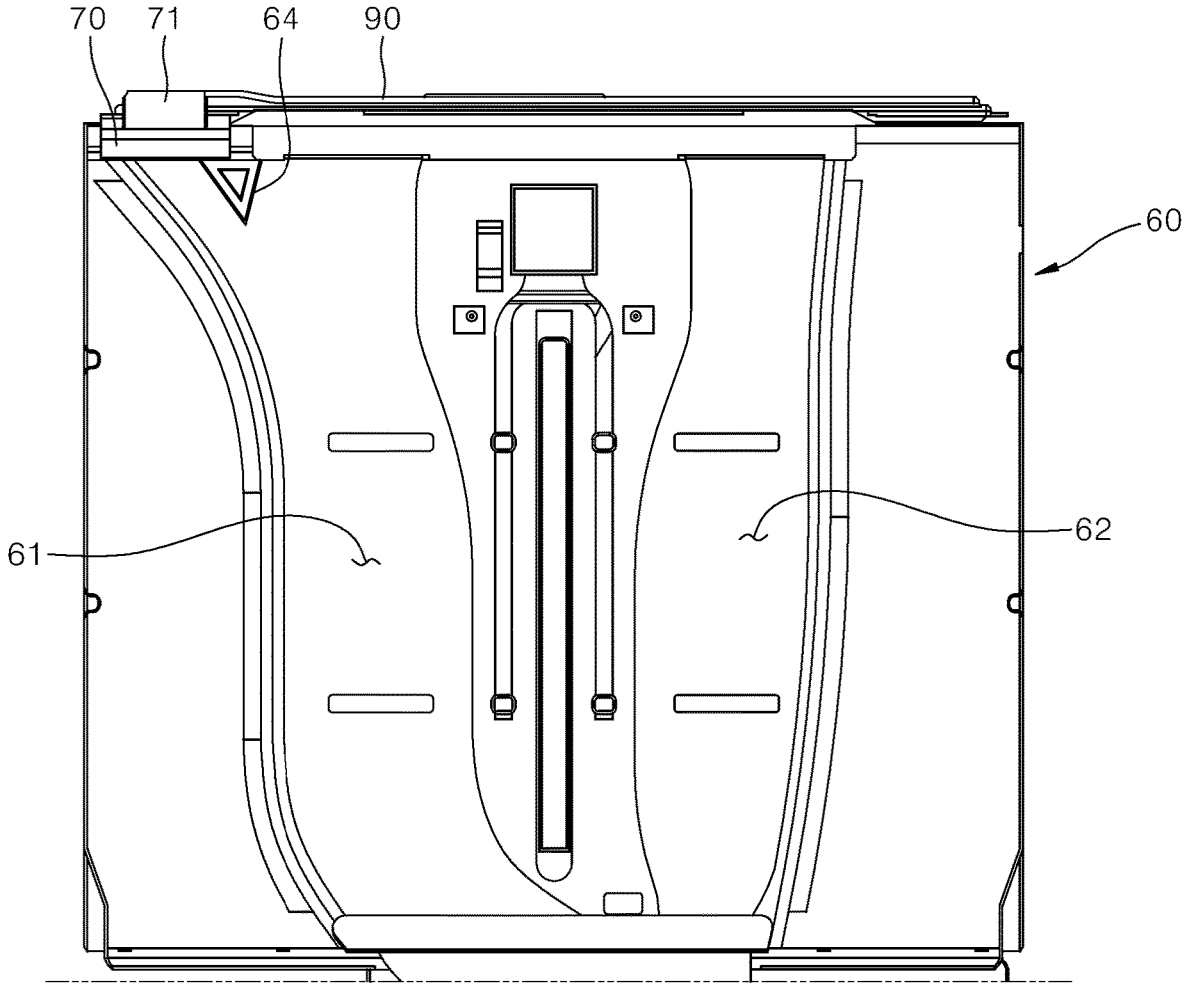
FIG. 4 is a view showing an internal structure of the multi-duct, together with the duct structure of FIG. 2.
Figure 5:
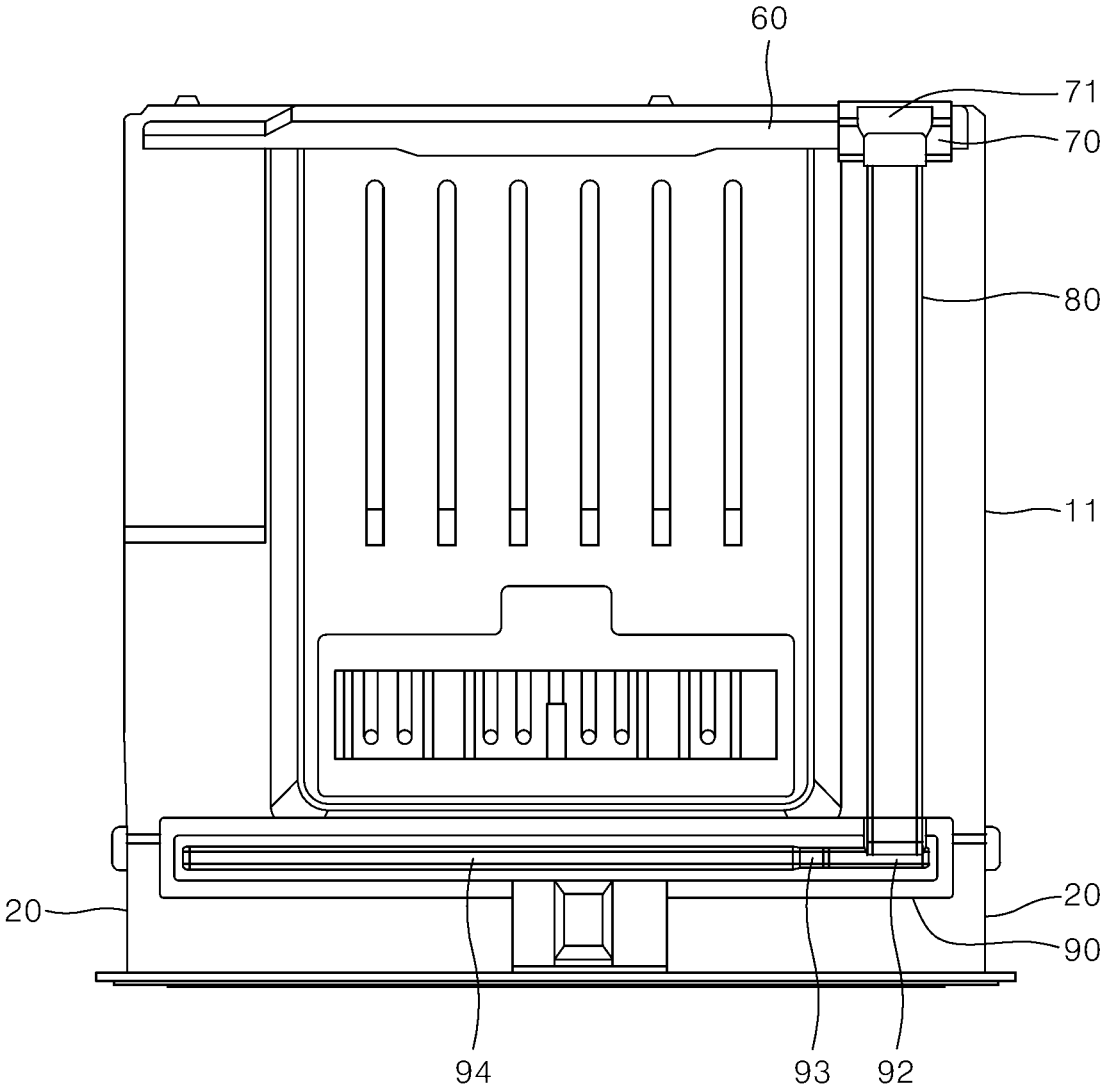
FIG. 5 is a top plan view of the duct structure of FIG. 2.

The connecting duct 80 is connected to one end of the upper end portion of the multi-duct 60 member. Referring to FIG. 4, the connecting duct 80 is provided in the end of the first partitioning portion 61 of the multi-duct 60. When the connecting duct 80 is disposed in the utmost outer side, it is possible to minimize the influence of the connecting duct 80 on controlling the flow quantity and the flow velocity of the cool air which is distributed into the internal space of the refrigerator through the outlet 63 and discharged. In addition, the connecting duct 80 is implemented in the form of being embedded in the upper member side of the cabinet, and is disposed in a one-sided position so as not to interfere with other elements or components that may be disposed in the ceiling portion of the cabinet, such as lighting.

The cool air sent to the connecting duct 80 is transmitted to the connecting duct 80 through a short-duct-typed connecting outlet 65 opened upward in the upper end of one side of the multi-duct 60. A refraction pipe 70 is disposed between the connecting outlet 65 and the connecting duct 80. The refraction pipe is provided with a first refraction portion 71 for changing the direction of the air which upwardly flows into the frontward direction. The connecting outlet 65 is coupled to the lower portion of the first refraction portion 71 and the connecting duct is coupled to the front of the first refraction portion 71.

According to the present invention, all of the multi-duct 60, the refraction pipe 70, and the connecting duct 80 are provided as a separate component. First, the multi-duct 60 is provided in the rear side of the interior space of the cabinet. Since the above described uppermost outlet 63 is opened upward, the upper end of the multi-duct 60 does not extend to the vicinity of the ceiling of the cabinet. Accordingly, the refraction pipe 70 is coupled the connecting outlet 65 protruding upward from the upper end of the multi-duct 60 (refer to FIGS. 3 and 4), so that the refraction pipe 70 can be disposed at a height corresponding to the ceiling portion of the cabinet. In addition, the connecting duct 80 can be embedded in the ceiling portion of the cabinet by coupling to the front of the refraction pipe 70.

According to this structure, the duct structure according to the present invention can be applied, while the shape of the cabinet is changed or the design is not changed or the design change is minimized in comparison with the existing refrigerator. In addition, as in the implementation of the present invention, if individual components are manufactured for each function, the production of each component can be simplified, and the component can be commonly used for the refrigerators of different standards and compatibility can be enhanced.

The flow cross sectional area of the first partitioning portion 61 extending to the connecting outlet 65 gradually widens from a certain height of the upper portion of the first partitioning portion of the multi-duct to the upper end of the first partitioning portion. That is, the width of the air flow path of the first partitioning portion gradually becomes wider when progressing upwardly. A guide wall 64 for guiding the cool air supplied to the connecting outlet 65 among the cool air that has flowed up to the upper end of the first partitioning portion and securing the amount of the cool air is provided in the upper end of the first partitioning portion, and may be formed in a shape of a triangular basin having a width increasing when progressing upwardly. The triangular basin is located in a section where the multi-duct is widened, and has a triangular shape gradually increasing in width similarly to the degree of widening of the first partitioning portion when progressing upwardly.

Such a guide wall 64, i.e., the triangular basin previously divides the cool air before the flow path of the air leads to the end of the first partitioning portion of the multi-duct, thereby sufficiently securing the supply amount of cool air, and can smoothly supply the cool air to the connecting duct side. In addition, since the width of the guide wall 64 is gradually widened toward the upper portion of the guide wall 64, the connecting outlet 65 can be spaced apart from the structure of the outlet 63. Therefore, it is possible to independently accomplish the cool air discharge design of the outlet 63 and the cool air discharge design of the connecting outlet 65 side, so that an easy design can be achieved. Further, since the connecting outlet can be disposed at the end portion as much, as described above, the ceiling space of the cabinet can be fully utilized.

Figure 7:
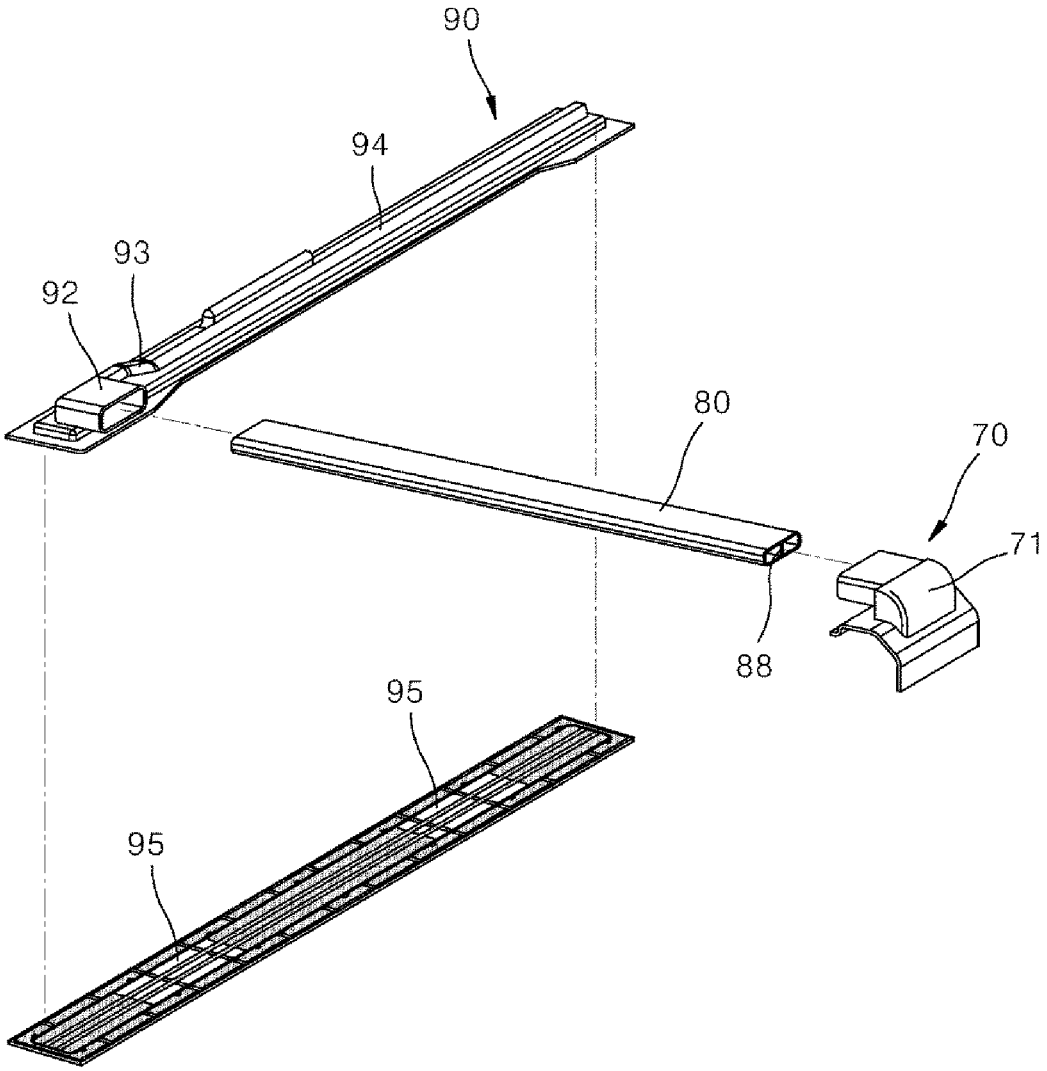
FIG. 7 is an exploded perspective view of a refraction pipe, a connecting duct, and a front duct of the duct structure of FIG. 2.
Figure 8:
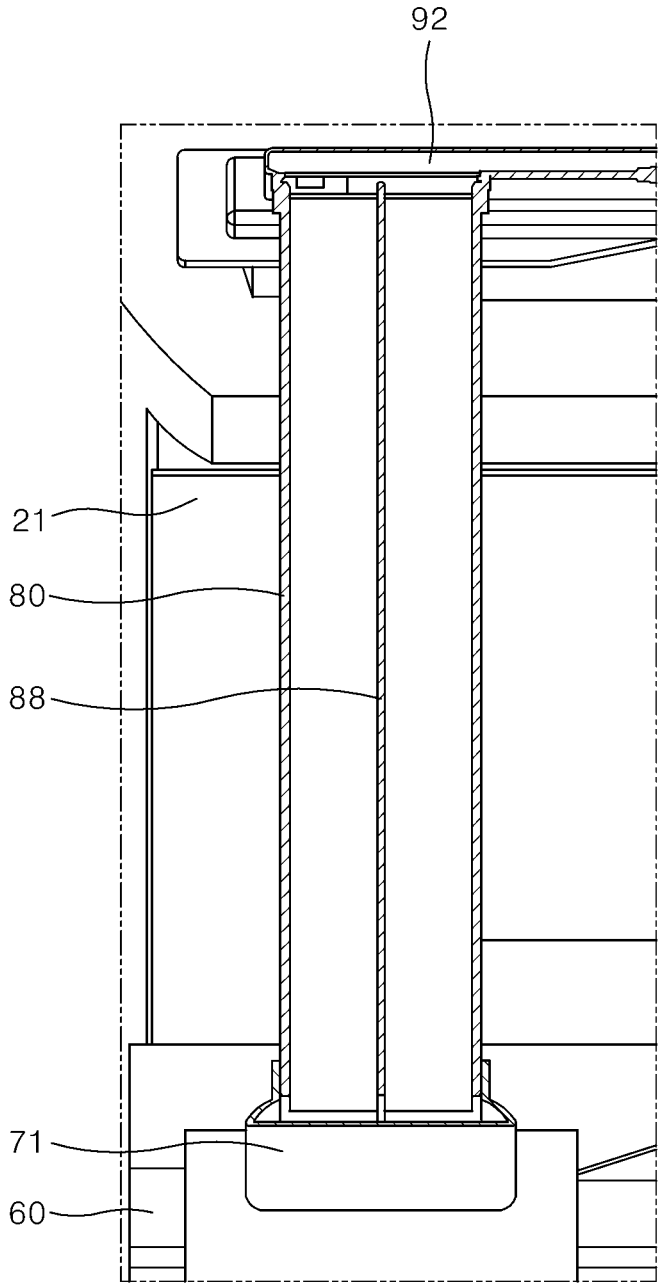
FIG. 8 is a cross-sectional view of a connecting duct portion of a duct structure.
Figure 9:
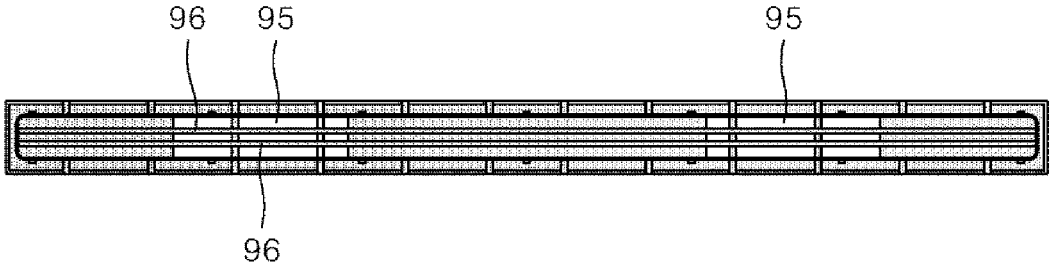
FIG. 9 is a view showing a nozzle unit and a split vane structure provided in a lower portion of a front duct.

The connecting duct 80 is implemented in the form of a flat and hollow pipe. The flow cross-section of the connecting duct has a flat rectangular shape having a width which is wider than a height, and a sufficient thickness of the heat insulating filler can be distributed to the lower and upper sides of the connecting duct when it is embedded in the ceiling space of the cabinet. In addition, as shown in FIG. 7, and as shown in FIG. 8 illustrating the sectional view of the connecting duct, a partitioning wall 88 dividing the flow cross section into two halves horizontally is formed in the connecting duct. Such a partitioning wall increases the flow velocity of the inside air of the connecting duct having a flat cross-section.

On the other hand, as shown in the drawing, each flow cross section divided into two halves by the partitioning wall still has a shape of a rectangle having a longer width than the height. In the implementation of the present invention, only a single partitioning wall 88 is provided. However, if the shape of each flow cross-section divided in the right and left directions by the partitioning wall is a rectangular shape having a longer width than the height, it is also possible to have three or four partitioning walls, and it is not necessary that the cross sections of the respective flow cross-sections divided by the partitioning wall requisitely coincide with each other. That is, it can be achieved with different forms and numbers based on a design intent.

In addition, according to the present invention, the connecting duct 80 is manufactured by a separate component from a front duct 90 described later. Therefore, the connecting duct 80 can be manufactured in a shape having a uniform cross-section along the longitudinal direction, so that it can be easily manufactured.

A front end portion, i.e., a fore-end of the connecting duct 80 is connected to the front duct 90. The front duct 90 is embedded in the inside of the front of the ceiling of the cabinet, and a nozzle unit 95 provided in the lower surface of the front duct is disposed in a position corresponding to the upper portion of the container space when the door 20 is closed.

The front duct 90 is provided with a second refraction portion 92 which is connected to the fore-end of the connecting duct 80 and which diverts the flow direction of the air flowing forward in the connecting duct to the side direction. If the inner wall structure for the air flow of the second refraction portion has a shape which suddenly changes the flow direction of the air, turbulence may occur and the flow direction of the air flow may not be smoothly changed and flow loss may occur. Therefore, it is preferable that an inner wall structure has a streamlined shape.

The opened rear portion of the second refraction portion 92 is inserted and coupled to the connecting duct 80, and coupled to a manifold portion 94 laterally. The manifold portion 94 is extended from the front of the ceiling portion of the cabinet in the horizontal direction, i.e., in the width direction such that it provides a flow path for passing the flow of cold air, which is diverted in the second refraction portion 92, from one end to the other end of the refrigerator. A guide accelerating portion 93 in the form of an incline or an oblique line having the flow cross-sectional area which gradually decreases from the second refraction portion toward the manifold portion is provided between the second refraction portion 92 and the manifold portion 94. The flow velocity of cool air is further increased as the cool air whose flow direction is diverted after passing the second refraction portion 92 passes through the tapered guide accelerating portion 93. Considering that the cool air can be flowed/transmitted evenly to the container space of the door only when the cool air is supplied at a flow velocity higher than a certain level, the above-described acceleration structure is more effective for the constant temperature operation of container space and the reduction of temperature gap.

The nozzle unit 95 for discharging air downward is provided in the lower portion of the manifold portion 94. The nozzle unit 95 is located in the upper portion of the container space of the door 20, and discharges cool air toward the container space. The flow velocity and the direction of the cool air discharged from the nozzle unit 95 are controlled by a split vane 96 provided in the front of the nozzle unit. The split vane 96 is a part exposed to the outside from the ceiling of the cabinet, and is not formed partly in a part where the nozzle unit 95 is provided, but is provided long in the width direction of the cabinet, i.e., in the horizontal direction, in consideration of external aesthetics.

The front duct 90 includes an upper component part in which the second refraction portion 92, the guide accelerating portion 93, and the manifold portion 94 are formed, and a lower component part in which the nozzle unit 95 and the split vane 96 are formed. In this case, since the upper component part is embedded in the inside of the cabinet and is surrounded by an insulating filler, it is not necessary to pay much attention to the appearance. However, since the lower component part is exposed to the outside, it is preferable that the lower component portion is manufactured in consideration of the harmony with the color of the inner wall of the cabinet, the uniformity of the material, and the like. In consideration of this point, in the present invention, the front duct is produced by dividing into an upper component part embedded in the ceiling of the cabinet and a lower component part exposed to the bottom of the ceiling of the cabinet. In the case of such a divisional production, the production itself may be simpler and easier.

The cool air that has flowed through the multi-duct, the refraction pipe, the connecting duct, and the front duct described above is finally directly supplied to the container space through the nozzle unit 95 located in the upper portion of the container space of the two doors 20. In the present invention, the cool air flowing forward through the connecting duct is directly supplied into the container space of the door without passing through the internal space of refrigerator. Therefore, when the duct structure 50 of the present invention is applied, it is possible to maintain a constant temperature in the container space of the door, and to reduce the temperature gap between the door-side container space and the internal space of cabinet.

In the duct structure described above, the refrigerating compartment is located in an upper portion, and a side-by-side type door is installed in the front of the refrigerating compartment. In this case, one side door is a door-in-door type, and the other is a general door-type door for the refrigerator.

However, the duct structure of the present invention is also applicable to a structure of a refrigerator having only one door. Further, even if the duct structure of the present invention is applied to a refrigerator to which a general door is applied rather than a door-in-door type, it can provide enough cool air to the food stored in the basket of the door, so that the refrigerating compartment can be kept at a constant temperature. In addition, it is needless to say that such a structure can also be applied to a refrigerating compartment disposed at the lower portion in a top freezer type refrigerator. In this structure, the connecting duct of the duct structure is embedded in a cabinet portion which divides the upper freezing compartment and the lower refrigerating compartment.

Meanwhile, in the present invention, it is illustrated that a structure in which the connecting duct is connected only in the first partitioning portion of the multi-duct, i.e., a structure in which the connecting duct is not formed in both sides but is connected to only one side in order to supply the cool air supplied to each door is applied when the side-by-side type door refrigerator is applied.

However, unlike the implementation of the present invention, the first partitioning portion and the second partitioning portion may be equally divided, the connecting duct may be provided in both ends, i.e., in the first partitioning portion and the second partitioning portion, and a pair of front ducts which have a length of about ½ or less of the width of the cabinet and which are connected to each connecting duct may be provided in the front of the connecting duct. However, this structure may be somewhat more cumbersome than the above-described implementation in that the number of components and the number of assembling operations increase.

In the case of a refrigerator having different structures, for example,

I) In the case where one side has a door-in-door structure and the other side has a general door structure, II) In the case where both sides have a door-in-door structure It is possible for the above described two refrigerators to implement the refrigerator type of I) and the refrigerator type of II) by simply installing the doors differently, without changing the other structure of the refrigerator.

At this time, if the connecting duct is desired to be installed on both sides, it is necessary to change the design in such a manner that the connecting duct is provided only in the door side having a door-in-door structure. That is, if the door is designed to have a corresponding connecting duct with respect to each door to which the door-in-door structure is applied, it is concluded that the duct structures of the refrigerator type I) and the refrigerator type II) should be applied differently.

However, in the case of a structure in which a connecting member is provided in only one side and a single long front side member is provided as in the above-described implementation, it is possible to use the components in common as there is no need to change the structure of the duct whether the refrigerator door is installed in the form of type I) or in the form of type II).

Hereinafter, the flow of cool air in the duct structure of the present invention is described. First, the flow of air generated by a fan (not shown) is cooled while passing through an evaporator (not shown) and is supplied to the lower portion of the multi-duct 60. The cool air supplied to the lower portion of the multi-duct 60 is divided into the first partitioning portion 61 and the second partitioning portion 62 while being moved upward. Since the flow cross section of the first partitioning portion 61 is about one and half times that of the second partitioning portion 62, the cool air is distributed at a similar rate and moved to the upper portion by flowing on each partitioning portion.

A part of the cool air moving upward is discharged forward through the outlet 63 provided in a certain position along the height direction of the multi-duct 60, and is supplied to the internal space of the cabinet divided by the shelf. The cool air flowing upward along the multi-ducts supplies appropriate cool air to the internal space of the refrigerator through each outlet 63. The cool air which has been distributed and flowed to the second partitioning portion 62 is used to be supplied to the internal space of the refrigerator after passing through the first, second, and uppermost third outlets.

On the other hand, the cool air which has been distributed and flowed to the first partitioning portion is used to be supplied to the internal space of the refrigerator after passing through the first, second, and uppermost third outlets. Furthermore, the cool air which is supplied 0.5 times more than the second partitioning portion is supplied to the connecting outlet 65. At this time, since the connecting outlet 65 is considerably spaced apart from the outlet of the first partitioning portion, the flow of cool air supplied to the connecting outlet 65 does not significantly affect the flow of cool air toward the outlet 63. Consequently, it does not have a significant effect on the flow of cool air in the internal space of the refrigerator.

The air that has flowed toward the connecting outlet 65 is guided to the connecting outlet 65 in a state in which the flow is surely divided by the guide wall 64 such that a turbulence which is generated when a flow of cool air runs into a blank wall does not occur. That is, the upper side of the guide wall in the form of a triangular basin is located at an interval between the connecting outlet 65 and the uppermost outlet 63 such that the cool air is prevented from bumping against an inner wall of blank wall, thereby preventing the occurrence of flow loss.

The cool air guided to the connecting outlet 65 flows along the streamlined inner wall of the first refraction portion 71 such that the flow direction is diverted forward while the occurrence of the flow loss is minimized. Then, the cool air is accelerated along the connecting duct 80 having a flow cross-section which is divided by the partitioning wall 88 and is moved forward.

The direction of the cool air reached in the front side is changed again laterally in the second refraction portion 92. The second refraction portion also minimizes the occurrence of flow loss during the direction change of the cool air by providing a streamlined flow trajectory. The cool air whose direction has been changed in the second refraction portion 92 is accelerated by passing through the guide accelerating portion 93 and enters the manifold portion 94. The cool air which has entered the manifold portion 94 moves in the width direction and is accelerated downward through the nozzle unit 95 provided in the lower portion, and is discharged into the container space of the door. The cool air accelerated and discharged into the container space is uniformly distributed in the container space, and the container space is uniformly cooled.

Since the temperature of the cool air discharged into the container space is equal to the temperature of the cool air discharged into the internal space of the refrigerator from the multi-duct, it is possible to increase the storage period of food by 40% or more based on the weight reduction rate of food 5%, by reducing the gap between the temperature of the air cooled in the container space and the temperature of the internal space of the refrigerator to 1 degree Celsius or below.

The partition cover 21 which is provided in the inside of the door so as to minimize the outflow of cool air when the door is opened may have a risk to serve as an element that hinders the cooling air of the internal space of the refrigerator from being uniformly and smoothly supplied to the container space. However, according to the present invention, the cool air can be sufficiently and smoothly supplied directly to the container space inside the partition cover, while minimizing the outflow of cool air by the partition cover structure when the door is opened, thereby achieving a constant temperature refrigeration of the container space of the door.

According to the present invention, the cool air is directly supplied to the container space provided in the door through the connecting duct and the front duct without passing through the internal space of the refrigerator such that the cool air can be smoothly supplied to the container space of the door irrespective of the storage position or state of food inside refrigerator.

According to the present invention, even if a partition cover is provided in the container space of door so as to prevent the outflow of cool air, the cool air can be directly supplied to the container space inside the partition cover, thereby smoothly achieving a constant temperature refrigeration of the container space of the door side. In particular, considering that the storage period of food is increased by 40% or more in case of a constant temperature refrigeration within 1 degree Celsius, the present invention can significantly extend the storage period of the food stored in the container space of the door.

According to the present invention, the cool air can be supplied directly and smoothly to the container space of the door side with a simple structure, and each component applied to the structure can be commonly used for or compatible with other refrigerator having a different specification such that the product quality and the maintenance are simple and easy.

According to the present invention, the cool air can be smoothly supplied to the container space of a plurality of doors provided in the front side of the refrigerator, thereby achieving a constant temperature operation of the entire space inside the refrigerator.

Hereinabove, although the present invention has been described with reference to exemplary implementations and the accompanying drawings, the present invention is not limited thereto, but may be variously modified and altered by those skilled in the art to which the present invention pertains without departing from the spirit and scope of the present invention claimed in the following claims.

What is claimed is:

1. A duct structure for a refrigerator that includes a door of the refrigerator, an internal space of the refrigerator, and a container space of the door, wherein the container space of the door is separated from the internal space of the refrigerator, the duct structure comprising:

a multi-duct that is located at a first portion of the internal space of the refrigerator, that is configured to discharge cool air into the internal space of the refrigerator, and through which cool air passes in a first direction;

a connecting outlet that is coupled to the multi-duct and through which cool air passes from the multi-duct;

a connecting duct that is coupled to the connecting outlet, that extends in a second direction, that is embedded in a ceiling of the internal space of the refrigerator, and through which cool air passes from the connecting outlet;

a front duct that is coupled to the connecting duct, that extends in a third direction corresponding to a width direction of the door, that is embedded in the ceiling of the internal space of the refrigerator, and that is configured to receive cool air from the connecting duct, the third direction being different from the second direction; and a nozzle unit that is coupled to the front duct, that is configured to be positioned vertically above the container space of the door based on the door being closed, and that is configured to discharge cool air into the container space of the door, wherein the front duct is configured to guide the cool air from the connecting duct to flow along the third direction corresponding to the width direction of the door.

2. The duct structure of claim 1, wherein the multi-duct comprises:

a first partitioning portion through which a first portion of cool air passes, and a second partitioning portion through which a second portion of cool air passes, wherein a width of the first partitioning portion is larger than a width of the second partitioning portion, and wherein the first partitioning portion is coupled to the connecting outlet.

3. The duct structure of claim 2, wherein the second partitioning portion is separated from the connecting outlet.

4. The duct structure of claim 2, wherein the connecting outlet is coupled to a first end of the multi-duct.

5. The duct structure of claim 4, further comprising:

a first refraction portion that couples the connecting duct to the connecting outlet.

6. The duct structure of claim 5, wherein the first refraction portion includes a pipe that is a separate component from the connecting duct.

7. The duct structure of claim 1, wherein the connecting outlet is coupled to a first end of the multi-duct.

8. The duct structure of claim 7, wherein the multi-duct comprises:

a guide wall that is configured to guide cool air to flow into the connecting outlet.

9. The duct structure of claim 8, wherein a first portion of the multi-duct is closer to the connecting outlet than a second portion of the multi-duct, and wherein a width of the first portion of the multi-duct is larger than a width of the second portion of the multi-duct.

10. The duct structure of claim 8, wherein the guide wall has a triangular basin shape.

11. The duct structure of claim 9, wherein a first portion of the guide wall is closer to the connecting outlet than a second portion of the guide wall, and wherein a width of the first portion of the guide wall is larger than a width of the second portion of the guide wall.

12. The duct structure of claim 1, wherein the connecting duct has a rectangular shape in a cross-section view, and wherein the connecting duct comprises a partitioning wall that is configured to divide an interior area of the connecting duct into a first partitioning portion and a second partitioning portion that extend in the second direction.

13. The duct structure of claim 5, further comprising:

a second refraction portion that couples the connecting duct to the front duct and that is configured to change a direction of cool air flow.

14. The duct structure of claim 13, further comprising:

a manifold portion that is coupled to the second refraction portion and that includes an inner flow space that extends in the third direction.

15. The duct structure of claim 14, further comprising:

a guide portion that couples the second refraction portion to the manifold portion, wherein a first portion of the guide portion is closer to the second refraction portion than a second portion of the guide portion, and wherein a cross-sectional area of the first portion of the guide portion is larger than a cross-sectional area of the second portion of the guide portion.

16. The duct structure of claim 14, wherein the nozzle unit is coupled to the manifold portion, and wherein the nozzle unit includes a split vane that is configured to divide cool air discharged from the nozzle unit in a direction perpendicular to the third direction.

17. A refrigerator comprising:

a cabinet that includes an internal space to store food in the internal space of the refrigerator;

a first door that is coupled to the cabinet, that is configured to open or close the internal space, and that includes a container space that is separated from the internal space of the refrigerator;

a multi-duct that is located at a first portion of the internal space of the refrigerator, that is configured to discharge cool air into the internal space of the refrigerator, and through which cool air passes in a first direction;

a connecting outlet that is coupled to the multi-duct and through which cool air passes from the multi-duct;

a connecting duct that is coupled to the connecting outlet, that extends in a second direction, that is embedded in a ceiling of the internal space of the refrigerator, and through which cool air passes from the connecting outlet;

a front duct that is coupled to the connecting duct, that extends in a third direction corresponding to a width direction of the first door, that is embedded in the ceiling of the internal space of the refrigerator, and that is configured to receive cool air from the connecting duct, the third direction being different from the second direction; and a nozzle unit that is coupled to the front duct, that is configured to be positioned vertically above the container space of the door based on the door being closed, and that is configured to discharge cool air into the container space of the first door, wherein the front duct is configured to guide the cool air from the connecting duct to flow along the third direction corresponding to the width direction of the first door.

18. The refrigerator of claim 17, further comprising:

a second door that is coupled to the first door, wherein, in a state in which the second door is open, the container space of the first door is accessible from an exterior area of the refrigerator.

19. The refrigerator of claim 17, further comprising:

a third door that is coupled to the cabinet, wherein the first door and the third door are provided side by side.

20. The refrigerator of claim 17, further comprising:

a partition cover that is coupled to the first door and that is configured to separate the container space from the internal space.

* * * * *